United States Patent [19]

Artajo

[11] 3,950,117

[45] Apr. 13, 1976

[54] MACHINE WITH ROTARY ARTICULATED PISTONS

[76] Inventor: Jose Ignacio Martin Artajo, Alberto Aguilera, No. 25, Madrid, Spain

[22] Filed: Mar. 4, 1974

[21] Appl. No.: 447,991

[30] Foreign Application Priority Data

June 27, 1973 Spain ..... 416371

[52] U.S. Cl. ..... 418/150; 123/8.45; 418/270

[51] Int. Cl.[2] ..... F01C 3/00

[58] Field of Search ..... 123/8.45; 418/150, 253, 418/270

[56] References Cited

UNITED STATES PATENTS

| | | | |
|---|---|---|---|
| 3,131,945 | 5/1964 | Scherenberg et al. | 418/142 |
| 3,295,505 | 1/1967 | Jordan | 123/8.45 |
| 3,314,401 | 4/1967 | Kell | 123/8.45 |
| 3,387,596 | 6/1968 | Niemand | 123/8.45 |
| 3,442,257 | 5/1969 | Walker | 123/8.45 |
| 3,614,277 | 10/1971 | Kobayashi | 418/253 |
| 3,696,796 | 10/1972 | Gavrun | 123/8.45 |
| 3,764,239 | 10/1973 | Huf | 418/113 |

FOREIGN PATENTS OR APPLICATIONS

| | | | |
|---|---|---|---|
| 1,401,424 | 10/1968 | Germany | 123/8.47 |

*Primary Examiner*—C. J. Husar
*Assistant Examiner*—O. T. Sessions
*Attorney, Agent, or Firm*—Mason, Kolehmainen, Rathburn & Wyss

[57] ABSTRACT

The present invention refers to a machine with rotary articulated pistons, which work within a cylindrical chamber. The machine could equally be a motor, compressor or pump to achieve transformations of energy.

3 Claims, 15 Drawing Figures

MACHINE WITH ROTARY ARTICULATED PISTONS

SUMMARY OF THE INVENTION

The present invention provides a rotary piston machine which comprises a number of articulated pistons disposed in a cylinder having a trochoidal form in such a manner to have the leading the trailing ends of the said pistons slidably and sealably in contact with the aforesaid trochoidal form, which produce volumetric changes between the piston and cylinder when one is rotated with respect to the other.

The pistons are supported pivotally by means of a system of connecting rods or links to a crankshaft rotatably mounted in the center of the machine.

It will be appreciated by anyone skilled in the art that several patents exist covering mechanisms constructed in a similar manner, but clearly fail to define the exact form of the cylinder for any number of pistons.

It will be further appreciated that these designs also fail to solve the real problems of this type of machine namely the design of efficient sliding seals and the method of obtaining the minimum volume required for combustion when the machine is used as a diesel motor.

In this invention the methods of obtaining the internal profile of the cylinder for any number of pistons are demonstrated and a method of reducing the minimum compression volume, heretofore known problems, is defined.

BRIEF DESCRIPTION OF THE DRAWINGS

By reference to the following specification the various features will be clearly understood. Drawing FIGS. 1–9 depict embodiments described in the aforesaid specification.

FIG. 1 is a diagramatic illustration of the geometric configuration of the mechanism, and represents the movement of a segment which slides by its ends along two straight lines concurrent in one point.

FIG. 2 represents the segment AB of FIG. 1 in three different positions.

FIG. 5 represents a cylinder internal profile developed from three primary curves, having each of said primary curves as a circle having radius $P_p$.

FIG. 6 represents a section along a vertical plane which passes through the shaft of the machine.

FIG. 7 represents a section of the piston showing its side wall, axial and lateral seals.

FIGS. 8 and 9 represent an embodied realization of the combustion chamber.

DETAILED DESCRIPTION OF THE PREFERRED EMBODIMENT

Figure 1:
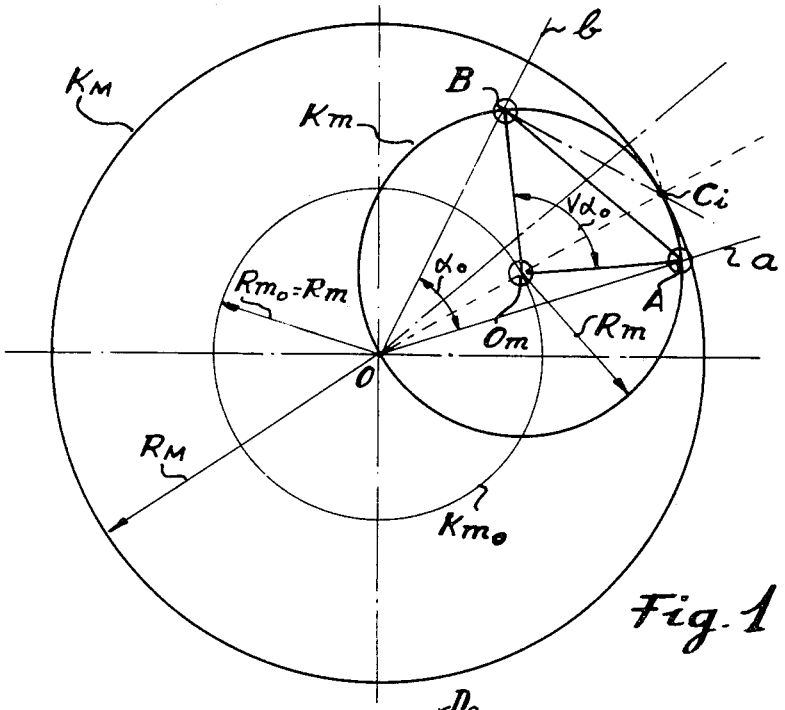

Having briefly described the essential elements of the machine, the development of the cylinder internal profile will now be described in conjunction with FIG. 1.

The segment $\overline{AB}$ is of length $L_o$ whose ends A and B move along the lines OA and OB, respectively. These lines are convergent at O, bounding the angle $\alpha_0$. The instantaneous center of rotation of the segment AB is $C_1$ determined by the intersection of the perpendiculars to the straight lines OA and OB at A and B. The angle $AC_iB$ is constant and its value is $AC_iB = \pi - \alpha_O$, as points A, $C_i$, B and O are in the circle $K_m$ whose diameter is $OC_i = AB/\sin \alpha_0 = 2R_m$. The center of the circle if always in the circle $K_{mo}$ with center O and radius $R_{mo} = R_m = ½\ OC_i$.

The geometry of the mechanism can be expressed:

Piston guidance results from the combination of the circle $K_m$ of radius $R_m$ and center $O_m$, moving on the circle $K_{mo}$ with center at O. The radius $R_{mo} = R_m = ½\ R_M$, $R_M$ being the radius of the fixed circle $K_M$ with a center at the shaft center ($R_M = \overline{OC_i}$). Therefore, this guidance is the result of a hypocylcloidal rolling of circle $K_m$ along the circle $K_M$.

The articulation of the pistons at a central point $O_m$ previously defined, is realized at points radially distant from the shaft by the said radius $R_{mo}$.

Figure 2:
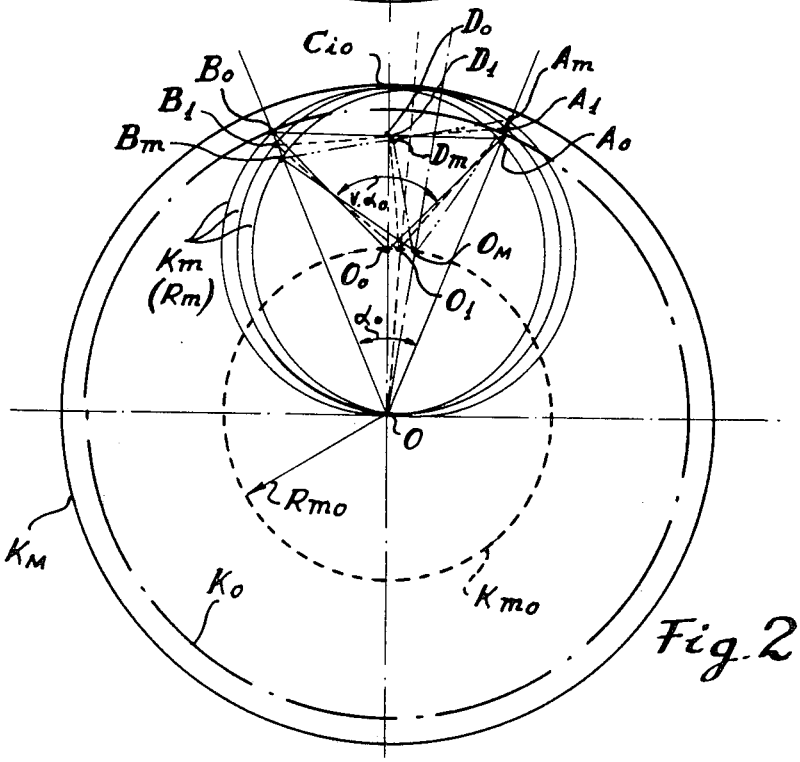
Figure 3A:
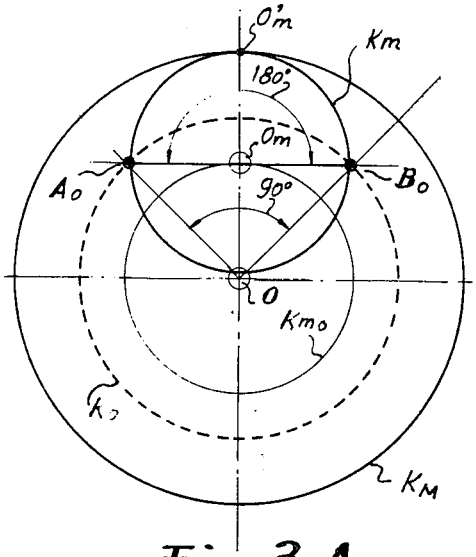
FIGS. 3A, 3B, 3C and 3D represent the segment $A_oB_o$ of FIG. 2 in its symetric position for four important cases $\alpha_o = 90°$, 60°, 45° and 30°.
Figure 3B:
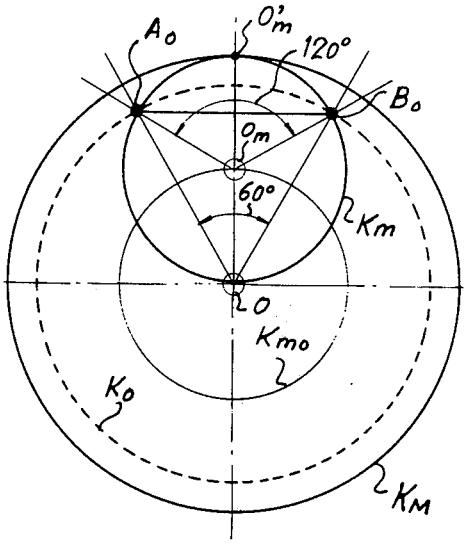
Figure 3C:
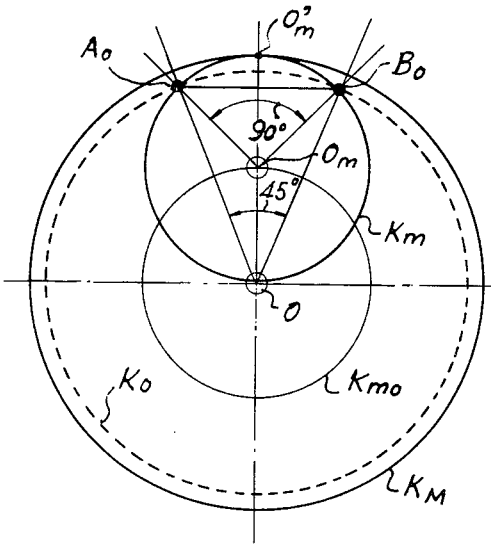
Figure 3D:
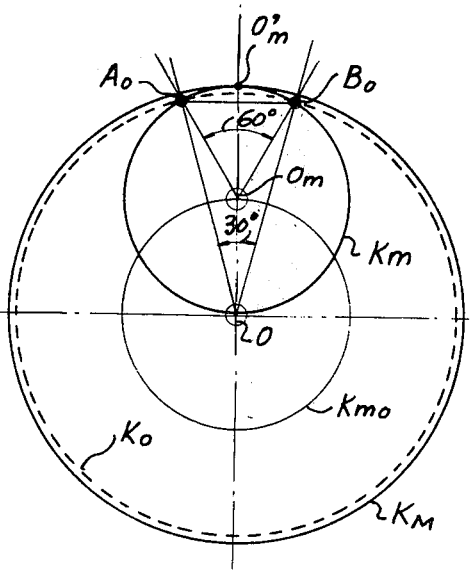

Referring to FIG. 2, it can be clearly seen that the point $O_m$ describes the circle $K_{mo}$ of the same radius $R_{mo} = R_m$.

The segment $\overline{AB}$ can be seen under an angle constantly equal to 2 $\alpha_o$ from centers at $O_O$, $O_1$, . . . $O_m$, etc.

Therefore points $O_O$, $O_1$, etc. lie on the perpendicular to the segments $\overline{A_OB_O}$, $\overline{A_1B_1}$, . . . etc. at their midpoints $D_O$, $D_l$ and being to the circle $K_{mo}$ with center at O. Thus verifying $$\overline{OA}^2 + \overline{OB}^2 - 2.\overline{OA} \times \overline{OB} \cos \alpha_o = \overline{AB}^2 = L_o^2.$$

FIG. 3 shows the angles $\alpha_o = 90°$, 60°, 45°, 30° and their corresponding values of $2\ \alpha_o = 180°$, 120°, 90° and 60° as components of a symmetrical system. This system can be seen to deform harmonically as the apices of the system move along straight lines which form the diagonals of a polygon, which has a side length $\overline{AB}$ or $L_o$. The term "deform harmonically" is used to describe the deformation that takes place in an equilateral polygon whose apices always move along the corresponding diagonals approaching or receding from the center O harmonically or symmetrically in alternate diagonals respectively.

FIGS. 3A, 3B, 3C and 3D show this aforementioned deformation for systems having an even number of sides $n = 4$, 6, 8, 12, etc. having the possibility to mount a number of pistons from 2 to $n$.

Figure 4A:
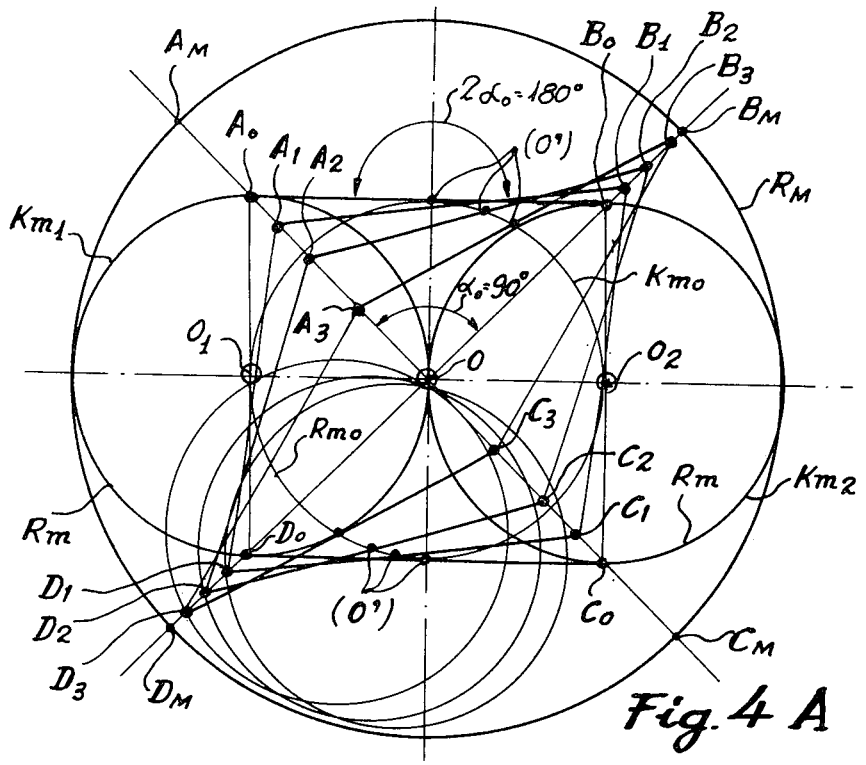
FIG. 4A and 4B represent two typical geometrical configurations.

FIG. 4A illustrates the harmonic deformation in the case of a square, where $\alpha_O = 90°$ and $2\ \alpha_O = 180°$.

Figure 4B:
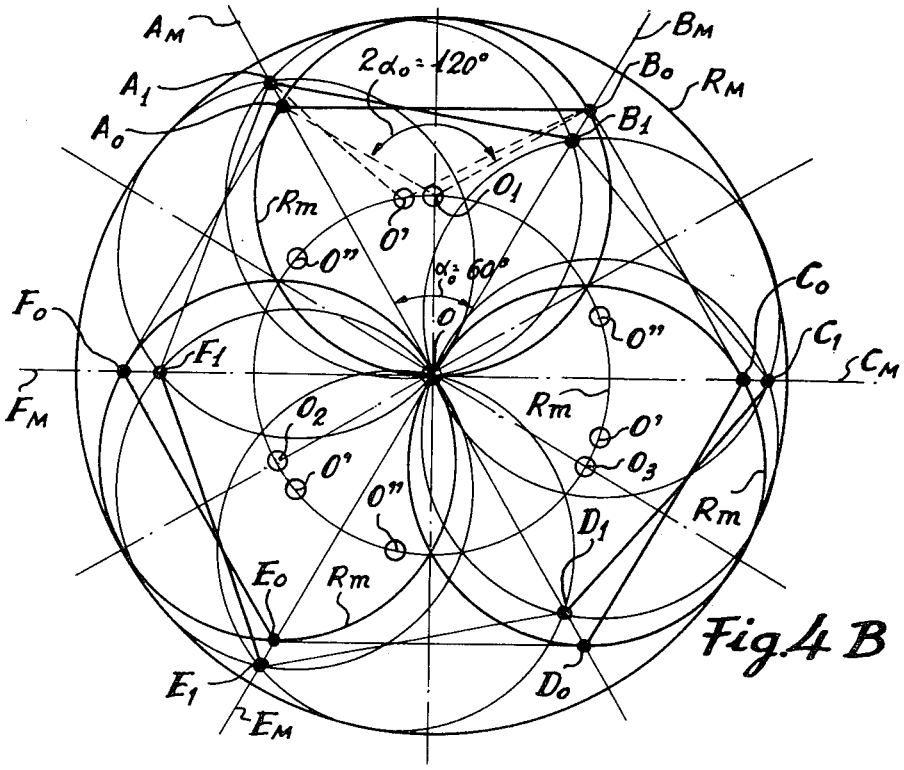

FIG. 4B is a further representation of the deformation, in this case $A_oB_oC_oD_oE_oF_o$ are the symetric positions of a polygon and $A_1B_1C_1D_1E_l$ positions of the same polygon harmonically deformed.

Figure 5:
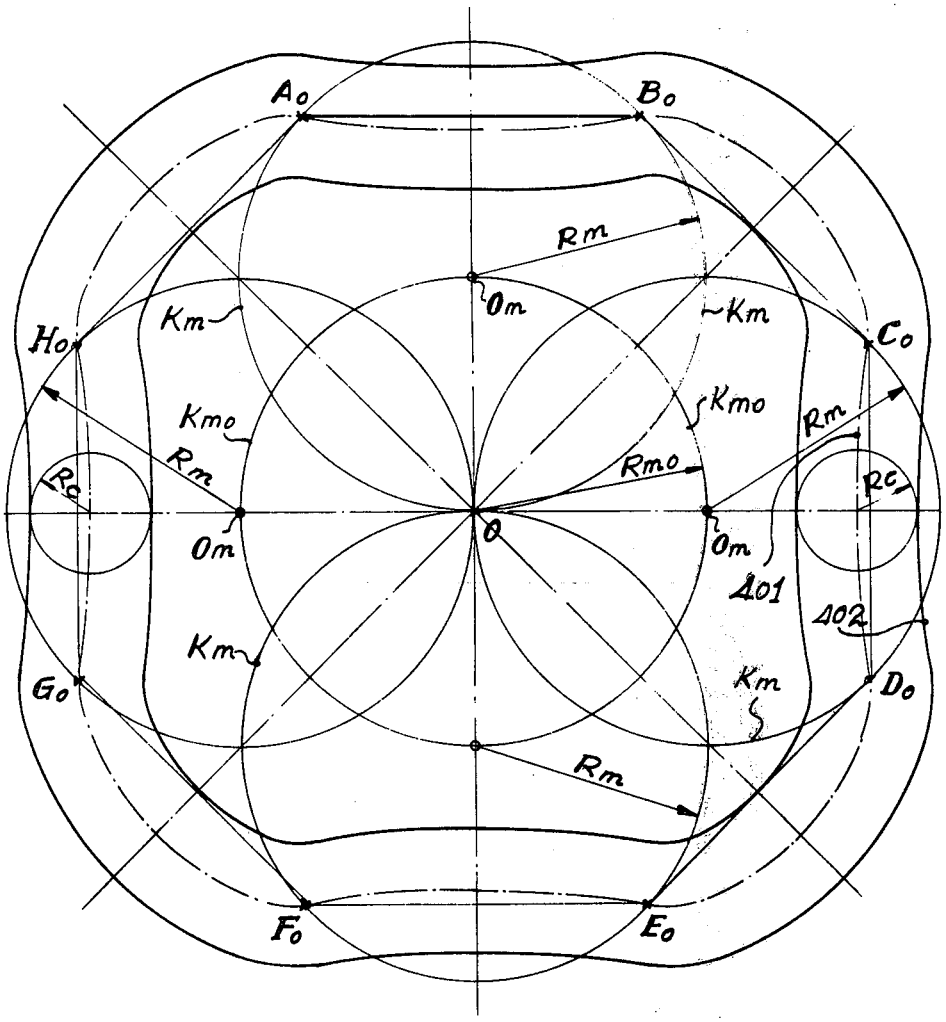

FIG. 5, as previously mentioned, demonstrates the internal cylinder profile that is formed by a series of curves trochoidally conjugated, the first or primary profile (arc. - $\overline{A_oB_o}$) is symmetrical between $\pm\alpha_o/2$ and the movement of the vector $\overline{OA}$ having A moving along the first or primary curve between $-\alpha_0/2$ and $+\alpha_0/2$ will generate, by the vector $\overline{OB}$, the secondary profile. This secondary profile is the locus of point B.

If $\rho_A$ is the length of the vector $\overline{OA}$ and $\rho_B$ the length of vector $\overline{OB}$ for any angular position of the crankshaft, then $\rho_B$ will be the vectorial value of the secondary profile where:

$$\rho_B = \cos \alpha_0 + \sqrt{(R_M^2 - \rho_A^2)} \sin \alpha_0$$

$$\frac{\rho_B}{\rho_A} = \frac{\cos (\alpha_0/2 + \alpha)}{\cos (\alpha_0/2 - \alpha)}$$

The angle $\alpha$ is formed between the perpendicular to the segment $\overline{A_m B_m}$ in its midpoint $D_m$ and the projection of the vector $\overline{OO_m}$ which has a value of O when $\rho_A = \rho_B$.

Clearly, the form of the primary profile can be of any convenient form and the form of the secondary profile will be generated according to the formula demonstrated above.

It is however convenient to consider this primary profile as a circle whose radius has an approximate value of:

$$R_p \approx 4R_M;$$

in view of the accelerations experienced by the points A and B when the crankshaft is rotated. It will be appreciated by anyone skilled in the art that the election of the value of $R_p$ will depend on many criteria and has an infinite number of solutions. Experience has shown that the above value produces excellent results. Clearly, modification of this value will not affect the principle of the invention.

Having defined an internal cylinder profile, it can be seen that the trochoidal form represents a locus of the points of contact A and B for any number of pistons. It will, however, be appreciated that, in order to accomodate the axial seals required, it can equally be formed by a further curve parallel to the locus lying outside the original, without detracting from the scope of the invention.

Patents representing the present state of the art fail to define a mathematical solution to the cylinder profile for any number of pistons.

Figure 5A:
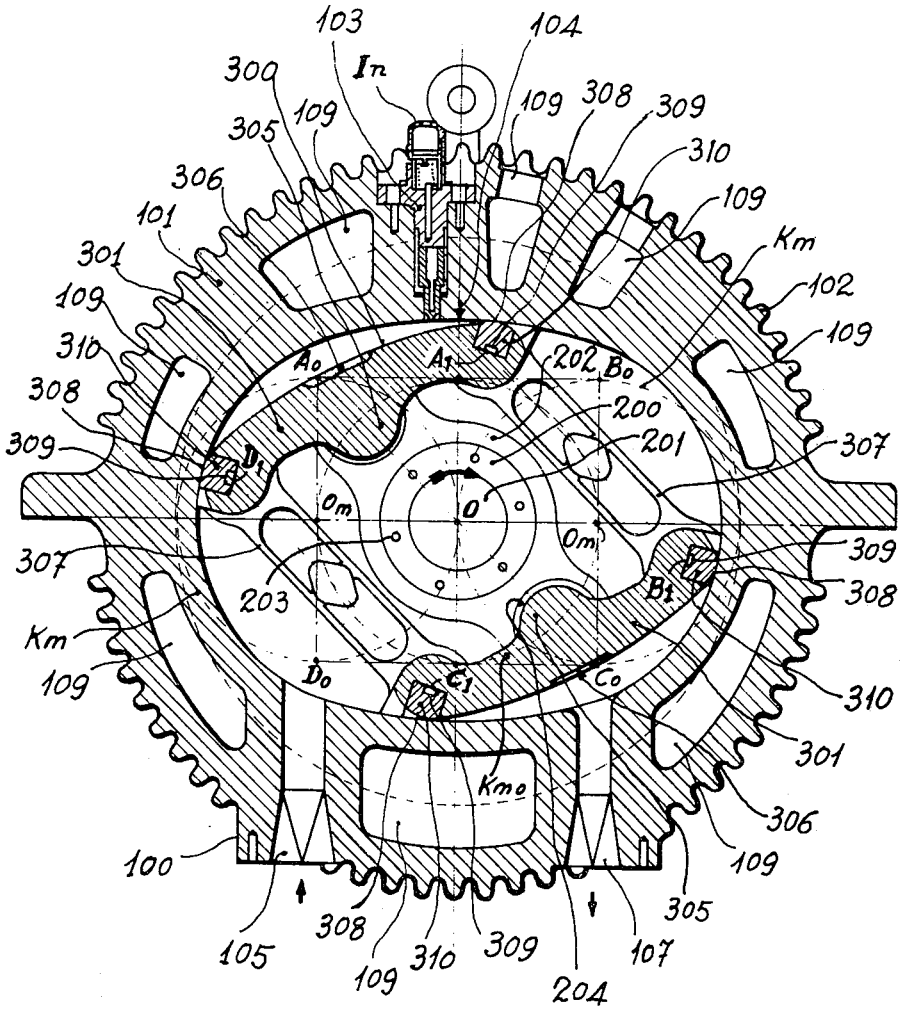
FIG. 5A represents a section of the machine along a plane perpendicular to the main shaft in the center of the machine.

Referring now to FIG. 5A, this shows the components of the invention constructed in the form of a motor.

The aforementioned cylinder is contained in a housing or body 101, exterior cooling ribs 102, fuel injection means 103, inlet port 105 and exhaust port 107 and water or air cooling ducts or galleries 109. The housing or body could clearly be of different physical shape without detracting from the invention.

Within the housing 101 is shown the cylinder profile previously described enclosing the pistons connected to the crankshaft 201 which rotates about its center O. The crankshaft is connected by way of a flange 200 to an arm 202 which in turn supports the pistons 301 by way of bearings housed in bosses 204 in the crank arm 202 and raised portions 305 on the pistons 301.

Connecting links 307 connect the pistons 301 by their extremes, at points $A_1$ $B_1$ $C_1$ $D_1$. These pivotally connected links 307 have these pivot centers $A_1$ $B_1$ $C_1$ $D_1$ on the trochoidal locus previously described.

Sealing members 310 are supported in the pistons 301, said sealing members heretofore referred to as axial seals make sliding contact with the cylinder profile parallel to the previously mentioned locus, at point 308. These seals 310 have chambers 309 therein which can conveniently accept springs to maintain the seal contact, in a known manner.

When the crankshaft 201 rotates in a clockwise manner, the arm 202 moves the upper piston 301 articulately mounted thereon along the cylinder profile in a manner to bring its face 300 closer to the cylinder reducing the volume contained between them. Meanwhile the same movement is effected to the lower piston. The resultant action of the machine produces transformations of energy giving or receiving torque to or from the crank 200 depending on its use as a motor, pump or compressor.

This description serves to illustrate the functioning of the embodiments of the invention and could clearly be modified without detracting from its scope.

Figure 5B:
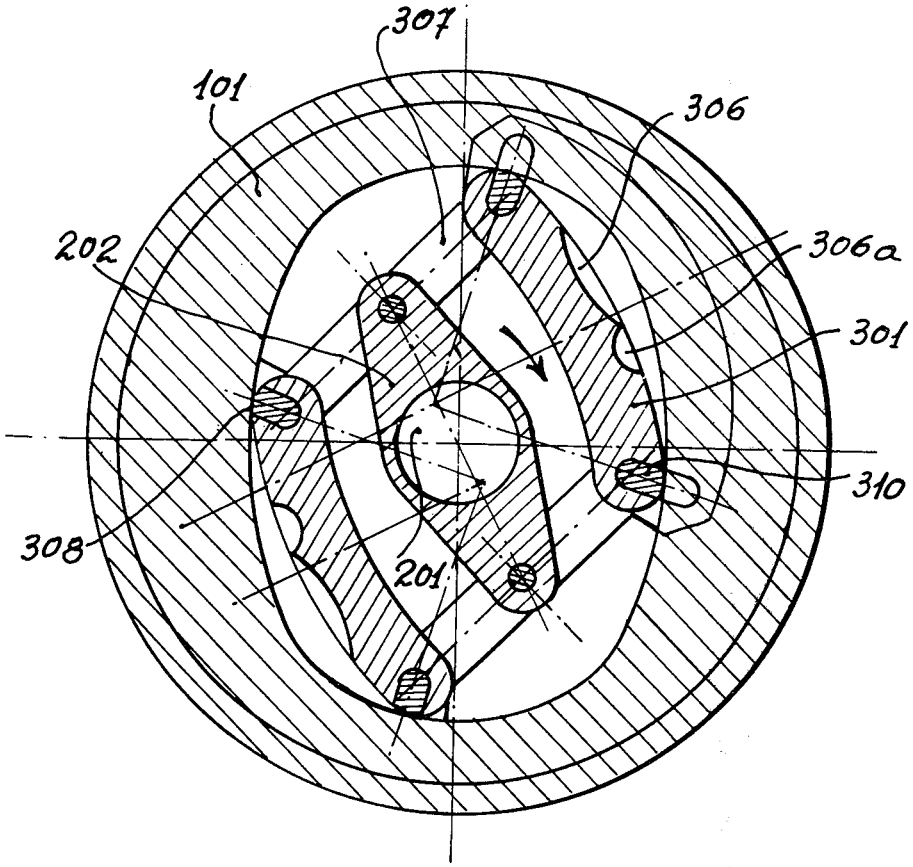
FIG. 5B represents the case of connection by intermediate rods or links.

FIG. 5B shows another version of the machine whereby the housing 101 contains a crankshaft 201 connected to the connecting links 307 by way of arm 202. These links 307 transmit rotary motion to the pistons 301 in a manner to maintain contact between them and the cylinder at point 308. This serves as a further demonstration of mechanically realizing a mechanism developed from the aforementioned mathematical formulae.

Figure 6:
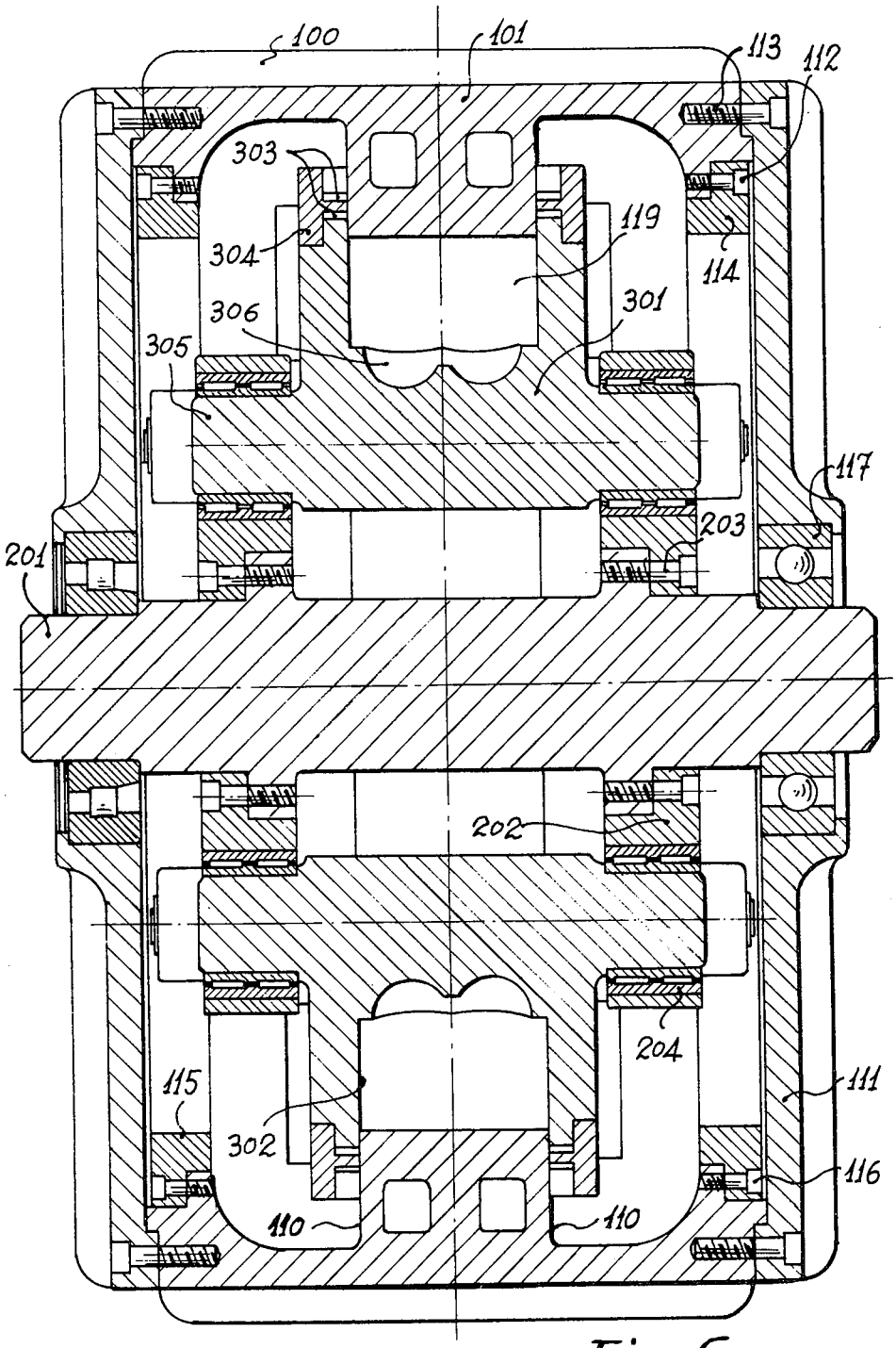

FIG. 6 shows a version of the machine by way of illustration of another of the preferred embodiments.

The crankshaft 201 is shown as the central axis of the machine. Connected to the crankshaft 201, by means of screw 203 or other known methods are the arms 202.

Roller bearing means 204 serve to locate the pistons 301 in an articulated manner. The pistons 301 having extended journals at 305 whose center lies on the circle $R_M$.

Sealing means 303, 304 heretofore named lateral seals serve to maintain the working chamber 119 hermetically sealed, these seals 303, 304 are mounted in the piston side walls 302 which move along two flanks 110 perpendicular to the cylinder profile.

Also shown are two end plates 111 as a method of sealing the entire mechanism. These plates carry crankshaft bearings which seals 117 and are connected to the cylinder housing 101 by means of screws 113.

The relations between the various components is shown by way of illustration only and can be varied by those skilled in the art without detracting from the scope of the invention.

Figure 7:
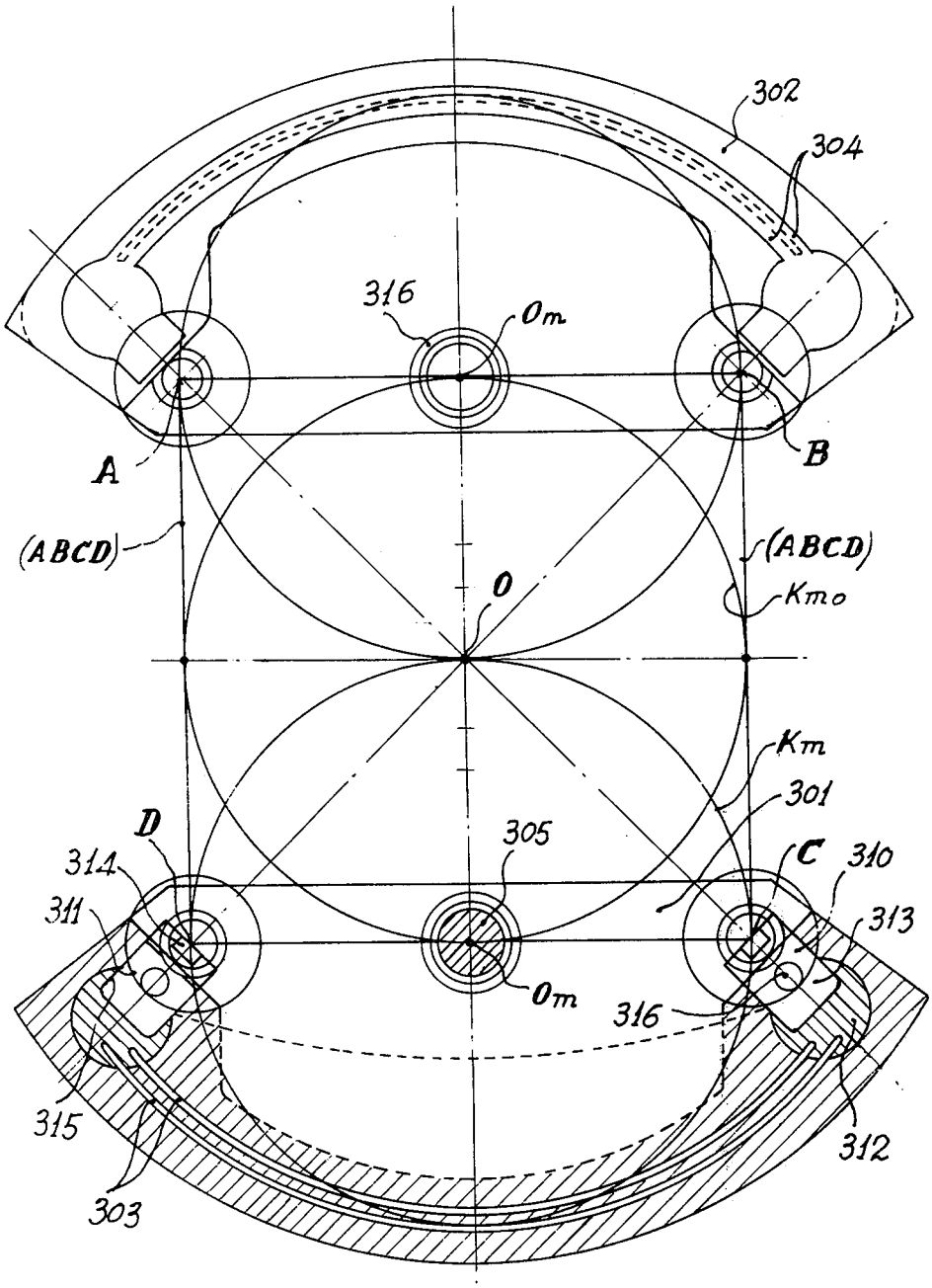

FIG. 7 shows a form of construction for the previously mentioned sealing members 310. The pistons 301 are shown in part section supported in an articulated manner by bearing means 316 by the piston journals 305. Each piston has two side walls 302 supporting axial sealing members 310 located with lateral seals 303 by way of a disc shaped sealing member 312 at the corners of the piston and its side walls. The axial seals 310 maintain contact with the cylinder profile at 311 and the lateral seals contact the cylinder flanks at 110 (FIG. 6).

Figure 8:
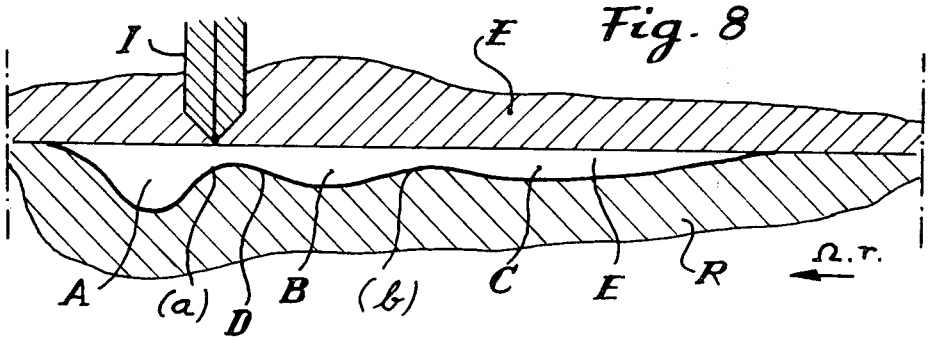
Figure 9:
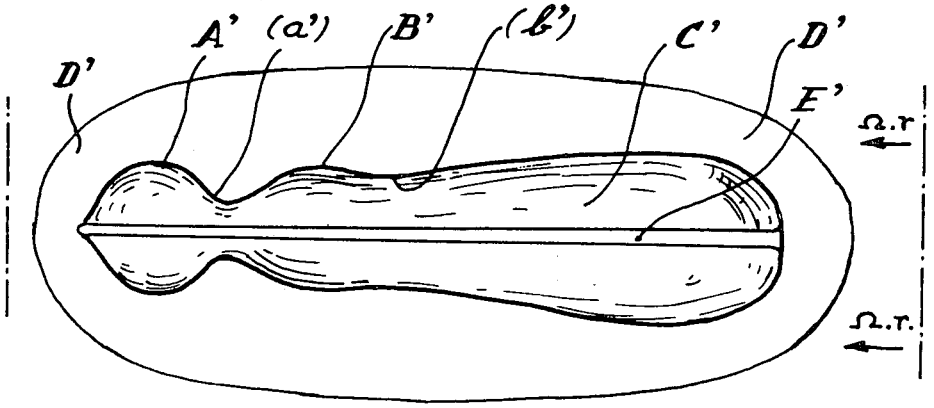

FIGS. 8 and 9 show a preferred form for a combustion chamber formed in the piston 301 in section (FIG. 8) and plan view (FIG. 9). In previous patents representing the present state of the art, mention of these chambers is made in conjunction with the larger combustion chamber, i.e. the volume contained between the piston and the cylinder. It is an important feature of this invention that the proposed combustion chamber exists solely of the dished chamber shown in FIGS. 8 and 9, because the pistons are in very close relation with the cylinder. An important feature of the piston design is that its face has a radius equal to the radius of the primary profile theoretically enabling a final compressed volume=O. In reality this enables high compression ratios to be achieved, suitable for diesel motor application. The effective combustion chamber is thereby contained in the piston. This has heretofore been impossible in the present state of the art, and this has resulted in minimum volumes relatively large with the piston at top dead center.

The exact form of the dished chamber shown is of a known type, familiar to those skilled in the art, but it must be remembered that in the case of this invention, the represents the entire combustion chamber, and not a small part as used heretofore. The advantages with respect to more efficient combustion, higher compression ratios, and less air pollution.

In the example heretofore described, the application of the machine as a motor, pump or compressor will be obvious with the omission or inclusion of valves, ignition and cooling devices of already known types and the versatility of the machine will not affect the scope of this invention.

All the foregoing descriptions are by way of example only and can clearly be modified within the terms of description without detracting from the intended purpose of the invention.

I claim:

1. A machine with rotary articulated pistons to be used as a pump, motor or compressor to effect thermodynamic transformation of energy, said machine comprising an outer body or housing having an internal cavity and including inlet and outlet ports in communication with said cavity in such a manner as to permit admission and expulsion of a gas, liquid, or fuel medium, the pistons rotatably received within said cavity and mounted upon a crankshaft extending into said cavity, internal profile of said cavity having a profile which is a conjugated trochoid, said profile being developed from the locus of a point or points of contact between said rotatably received pistons moving in slideable and sealable contact with the said conjugated trochoidal profile of said outer body or housing, said pistons being connected to said crankshaft by connecting links pivotally connected to said pistons at the ends thereof, and, arms connected to said crankshaft and the midpoints of said links, thereby forming a mechanism to transmit torque to or receive torque from said crankshaft.

2. A machine with rotary articulated pistons as defined in claim 1 wherein the midpoints of said connecting links are connected to said arms protruding radially from and connected to the central crankshaft, said connecting point between said connecting links and said arms forming a load bearing journal capable of guiding said pistons in the required manner and permitting said load bearing journals to be situated away from the piston center in a position where it will be more easily cooled.

3. A machine as described in claim 1 whereby the said conjugated trochoidal form of the cylinder profile located within said outer body or housing is defined by at least two primary profiles and an equal number of secondary profiles developed from said primary profiles, said secondary profile uniting alternate primary profiles to produce a continuous cylinder profile, said primary profiles being defined by the path of said pistons and being in number of two or more and the resulting secondary profiles produce a complete internal cylinder profile whose form will vary depending on the form and number of said primary profiles.

* * * * *